United States Patent [19]

Foglio et al.

[11] Patent Number: 5,000,362

[45] Date of Patent: Mar. 19, 1991

[54] SHUT-OFF DEVICE MADE OF REFRACTORY MATERIAL FOR A SLIDE-GATE POURING APPLIANCE

[75] Inventors: Salvatore Foglio, Taranto; Giovanni Timossi; Roberto Ricci, both of Genoa, all of Italy

[73] Assignees: Nuova Sanac S.p.A.; Ilva S.p.A., both of Genoa, Italy

[21] Appl. No.: 563,959

[22] Filed: Aug. 7, 1990

Related U.S. Application Data

[63] Continuation of Ser. No. 363,721, Jun. 9, 1989, abandoned.

[51] Int. Cl.[5] ..... B22D 41/22

[52] U.S. Cl. ..... 222/600

[58] Field of Search ..... 222/590, 597, 600; 266/287

[56] References Cited

U.S. PATENT DOCUMENTS

| | | | |
|---|---|---|---|
| 3,980,271 | 9/1976 | Hind et al. | 222/600 |
| 4,076,153 | 2/1978 | Tinnes | 222/600 |
| 4,582,232 | 4/1986 | Shapland et al. | 222/600 |
| 4,597,514 | 7/1986 | Thrower | 222/600 |
| 4,718,580 | 1/1988 | Bierbaum et al. | 222/600 |
| 4,789,085 | 12/1988 | King | 222/600 |

*Primary Examiner*—S. Kastler

*Attorney, Agent, or Firm*—Fleit, Jacobson, Cohn, Price, Holman & Stern

[57] ABSTRACT

The invention refers to a slide-gate shut-off device made of refractory material, of the type having a fixed holed refractory plate (30), a sliding holed refractory plate (40) and underneath the latter solidly joined to it (50), above the fixed refractory plate (30) a fixed refractory sleeve (20), also known as the internal pouring appliance, around which a pouring-appliance holder (11-12) is arranged.

According to the invention, these refractory plates (30, 40) are holed in the center and have a double symmetry; furthermore, said internal pouring appliance (20) becomes gradually thinner towards the top, and at its lower base has a radial thickness approximately double that of the lower sliding refractory sleeve (50), known as the external pouring appliance, the radial thickness of which is approximately equal to the radius R of the casting holes in the refractory plates (30, 40).

21 Claims, 5 Drawing Sheets

SHUT-OFF DEVICE MADE OF REFRACTORY MATERIAL FOR A SLIDE-GATE POURING APPLIANCE

This is a continuation of application Ser. No. 07/363,721, filed June 9, 1989, now abandoned.

BACKGROUND OF THE INVENTION

Slide-gate pouring appliances for ladles and similar devices have been commonly used for about two decades now. They were however designed far earlier, at the beginning of the last century, and the long delay before they were applied must be blamed on the fact that to enable them to operate properly, refractory bricks with high mechanical, thermal and chemical properties are required.

These properties have become available only relatively recently, and since then slide-gate pouring appliances have continued to become increasingly widespread.

First of all they were applied to smaller gates and then, gradually, to larger ones.

Ever since slide-gate pouring appliances were first introduced, attempts have been made to find solutions allowing replacement of at least some of the firebricks from outside the ladle, thus simplifying and speeding up maintenance operations.

It is well-known that the basic refractory elements of a slide-gate shut-off device consist of two holed plates of which one fixed and one sliding, of a sleeve below the sliding refractory plate known as the external pouring appliance and a sleeve above the fixed refractory plate known as the internal pouring appliance.

The internal pouring appliance is not directly surrounded by the refractory lining of the ladle, but isolated from it by means of a larger sleeve, called the pouring-applicance holder and which, unlike the internal pouring appliance has to be fitted and replaced from inside the ladle.

This pouring-appliance holder is also an integral part of the slide-gate pouring appliance.

In designing the refractory parts of slide-gate shutoff devices, it is of the utmost importance to achieve uniform wear of the parts so as to space maintenance activities efficiently.

It is however not easy to achieve similar rates of wear for elements working in different ways and therefore in the past it was found preferable to simplify the typology of the refractory elements forming the pouring appliance so at least the number of parts to be stocked was reduced.

This criterion is used in nearly all cases, but the different wear rates of the various components are magnified by the increased dimensions of the shut-off devices, and it is therefore necessary to choose between two alternatives:

(a) To reduce the number of stoppages for maintenance activities by replacing all the parts at the same time, even if some are only partly worn;

(b) To increase the number of stoppages for maintenance activities, replacing each time only those parts which have reached the maximum permissible limits of wear.

The first of these alternatives means a considerable waste of materials, and the second means interrupting the work cycle more frequently, reducing the exploitation of the production facilities.

The aim of this invention is to implement a large slide-gate shut-off device, the parts of which will wear out at the same rate.

In this way it will be possible to space maintenance activities further apart, without the wastages caused by early replacement of parts which are not yet fully worn out.

According to this invention, this aim has been fulfilled not only simply by increasing the dimensions (for example the thicknesses) of the parts which wear out more rapidly but also and above all by correctly configuring the various parts of the shut-off device.

BRIEF SUMMARY OF THE INVENTION

The slide-gate shut-off device according to the invention has: (a) a fixed holed refractory plate, (b) a sliding holed refractory plate, below it, (c) a sleeve made of refractory material solidly connected to the latter, above the fixed refractory plate, (d) a fixed refractory sleeve, also known as the internal pouring appliance, around which a holder (e) is arranged.

According to this invention the refractory plates are holed in the centre and are doubly symmetrical; in addition, said internal pouring appliance becomes gradually thinner towards the top and the radial thickness of its bottom base is about double the radial thickness of the internal sliding refractory sleeve. The radial thickness of this sliding refractory sleeve is approximately equal to the radius R of the pouring holes in the fixed and sliding refractory plates.

By adopting these dimensional ratios, a practically uniform wear rate of all the refractory parts has been achieved, leading to a good degree of efficiency in the exploitation of the system.

DETAILED DESCRIPTION OF THE INVENTION

Figure 1:
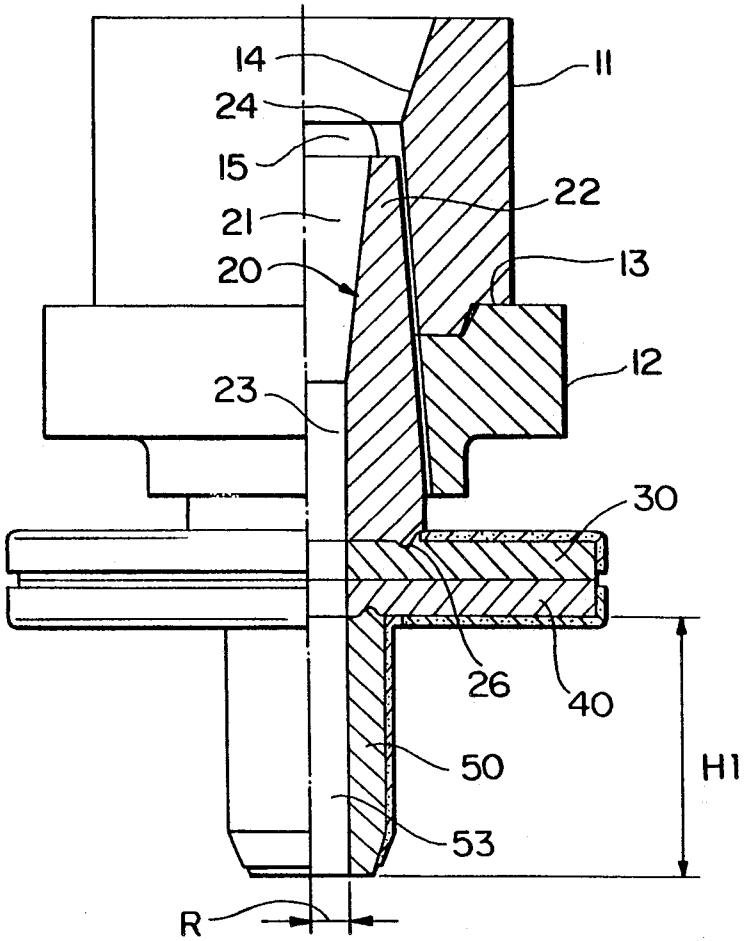
FIG. 1 is a side view, shown half as a radial cross-section, of the shut-off device according to the invention.
Figure 2:
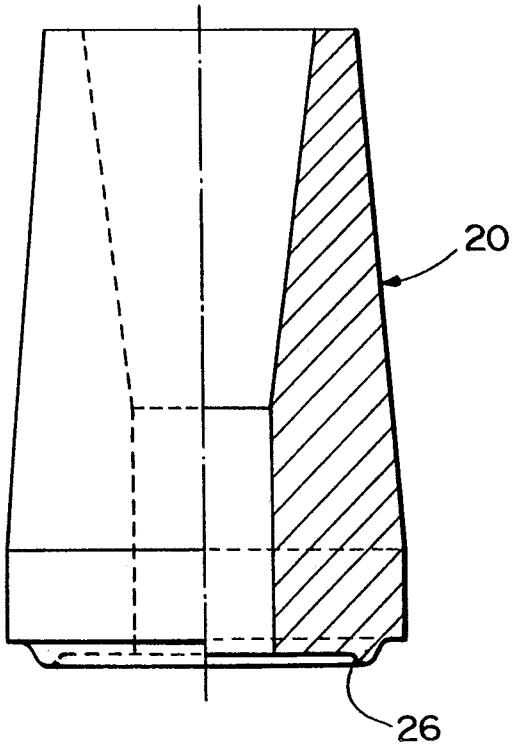
FIG. 2 is a side view, shown half as a radial cross-section, of the upper fixed sleeve, also known as the internal pouring appliance.

With specific reference to the above drawings, the shut-off device made of refractory material according to the invention includes an internal pouring-appliance holder made up of two superimposed elements indicated by 11 and 12, the mating surface of which is fitted with a centering key 13.

These two elements have to be fitted from inside the ladle and of course their replacement times will be far longer than the replacement times of the remaining refractory elements of the shut-off device, which can be disassembled and reassembled from outside the ladle. The inside surface of the pouring-device holder 11-12 has a first upper piece, truncated-cone shaped, 14, open at the top where it is shaped like a funnel suitable for conveying the liquid metal downwards.

The height of this first part, indicated with the number 14, is about 2–3 times the radius R of the minimum cross-section of the duct through which the liquid metal passes.

For the purpose of this description the value of said radius R shall be assumed as a conventional unit of measurement.

The radius R is chosen, from time to time, depending on the dimensions of the ladle and of the capacity of the devices downstream from the latter which have to receive the flow of molten steel.

The tangent of the opening angle of the conical surface 14 is comprised between above 0.2–0.4; below this first conical portion there is a second, cylindrical, portion 15, the height of which is equal to about 0.2–2 times R.

Below this, the inside surface of the pouring-appliance holder 11-12 has again a conical shape, opening out towards the bottom, and the angle of opening of which is about 2–6 degrees.

This angle allows the internal pouring appliance 20 to be inserted or removed from underneath.

The internal pouring appliance 20 has a height of about 10 times R, and is passed through by a hole 21 formed by an upper conical part 22, and a lower cylindrical part 23. The height of the lower cylindrical part 23 is about 3–4 times R. The tangent of the angle at the vertex of the conical surface 22 is approximately equal to 0.15–0.45.

The width of the upper ring-shaped base 24 of the internal pouring appliance 20 is approximately equal to R and starts just below the cylindrical part 15 of the pouring-appliance holder 11-12.

In this way a step is created which will wear out progressively due to the abrasive effect of the liquid steel, gradually transforming the conical surfaces 14 and 21 into a single surface shaped more or less like a paraboloid of revolution.

The flow of liquid steel is now directed towards the boundary and enters the cylindrical duct 22-23 causing less wear.

The radial thickness of the lower ring-shaped base 25 of the internal pouring appliance 20 will be approximately equal to 2R. The lower ring-shaped base 25 of the internal pouring appliance 20 has a circular rib 26 located in the vicinity of the outer rim of the base itself.

This circular rib serves as a centering element between the lower base of the internal pouring appliance 20 and the upper surface of the fixed refractory plate 30 which is equipped with a corresponding groove 31.

The plate 30 is equipped with a central hole having a radius R, and its thickness is approximately the same; the remaining relative dimensions of the fixed refractory plate 30 are described in detail below.

The underside of the fixed upper plate 30 is accurately flattened, since it serves as a sealing surface over which the upper surface of the underlying sliding refractory plate 40 slides.

The sliding plate 40 also has a central hole 42, and on its underside a circular groove 41 which accommodates a corresponding rib 51 protruding from the upper ring-shaped base 52 of the lower sleeve 50, which slides together with the lower plate 40 and forms the external pouring appliance.

The radial thickness of the lower sleeve 50 is approximately equal to R, and its height Hl is about 6–12 times the radius R of the pouring hole.

The hole 53 of the lower sleeve 50 is cylindrical, and its lateral surface 54 is also cylindrical although it has at the bottom a conically bevelled edge which makes it easier to insert the lower end of the external pouring appliance into the upper end of an underlying plunger type pouring appliance below it.

Figure 3:
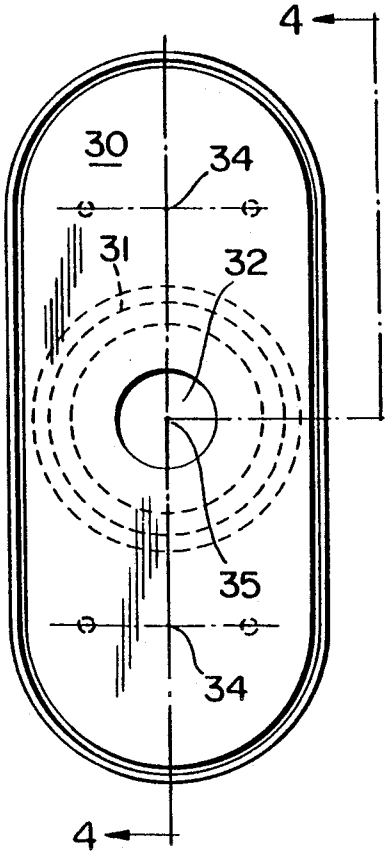
FIG. 3 is a view from below of the fixed refractory plate, inserted in its metal container.
Figure 4:
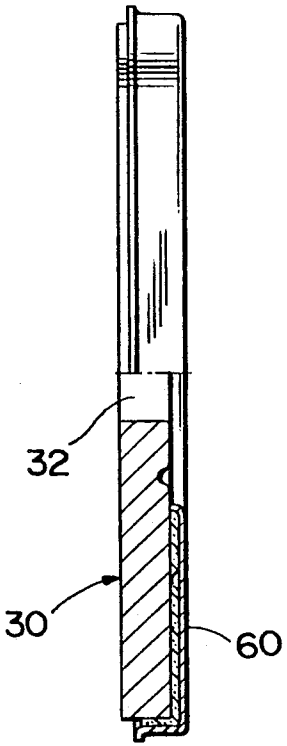
FIG. 4 is a side view of the same refractory plate, shown half as a cross-section.
Figure 5:
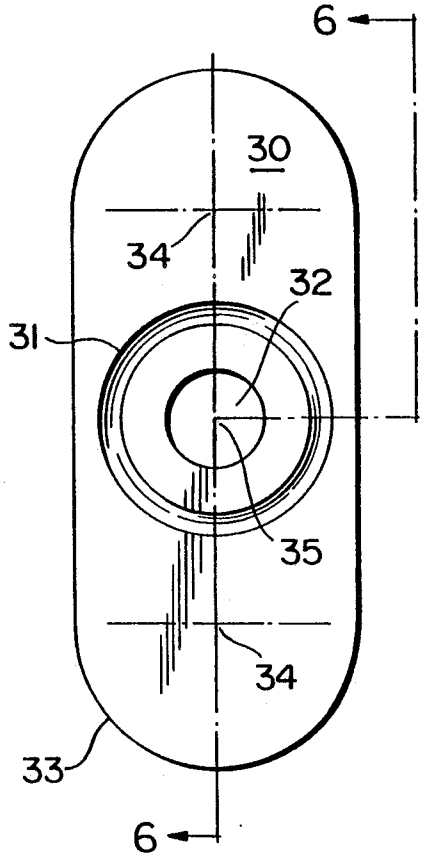
FIG. 5 is a view from below of the fixed refractory place, without its metal casing.
Figure 6:
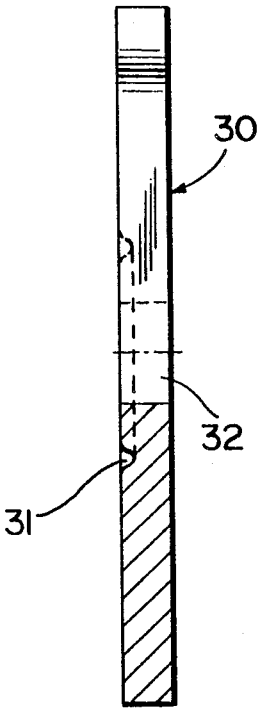
FIG. 6 is a side view of the fixed refractory plate, without its metal casing, shown half as a cross-section.
Figure 7:
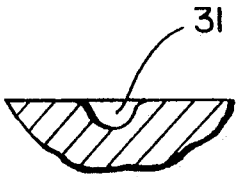
FIG. 7 is an enlargement of the detail indicated by the circle VII in FIG. 6 and by the circle VII/A in FIG. 16 described below.
Figure 8:
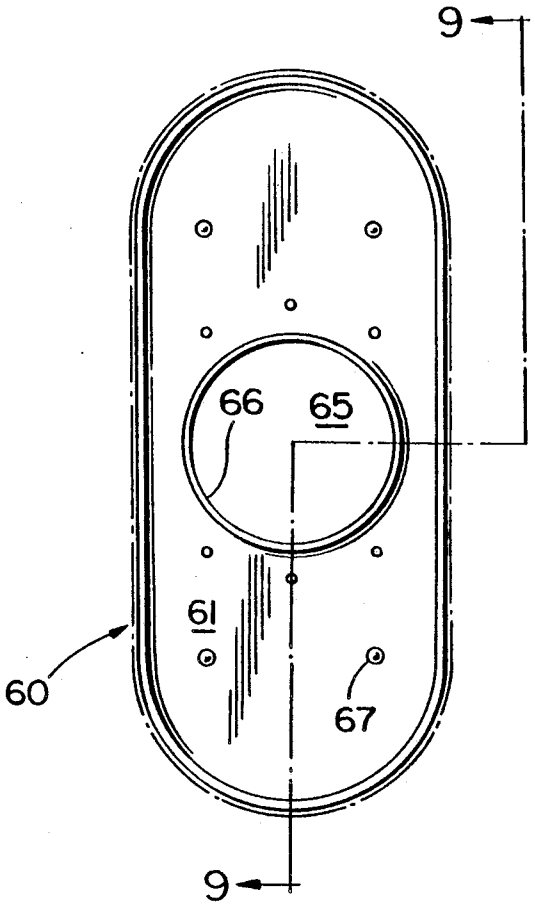
FIG. 8 is a view from below of the metal casing of the fixed refractory plate.
Figure 9:
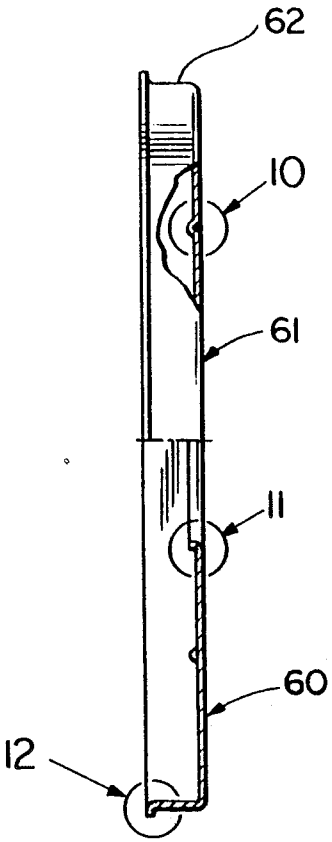
FIG. 9 is a side view of the same casing, shown half as a cross-section.
Figure 10:
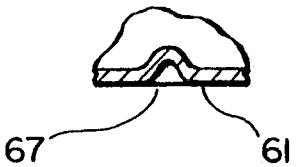
FIGS. 10, 11 and 12 are, on an enlarged scale, the details indicated by the circles X, XI and XII in FIG. 9 above and by the circles X/A. XI/A and XII/A in FIG. 18 described below.
Figure 11:
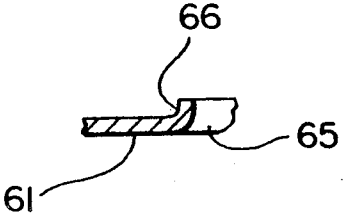
Figure 12:
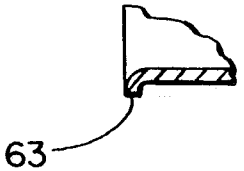
Figure 13:
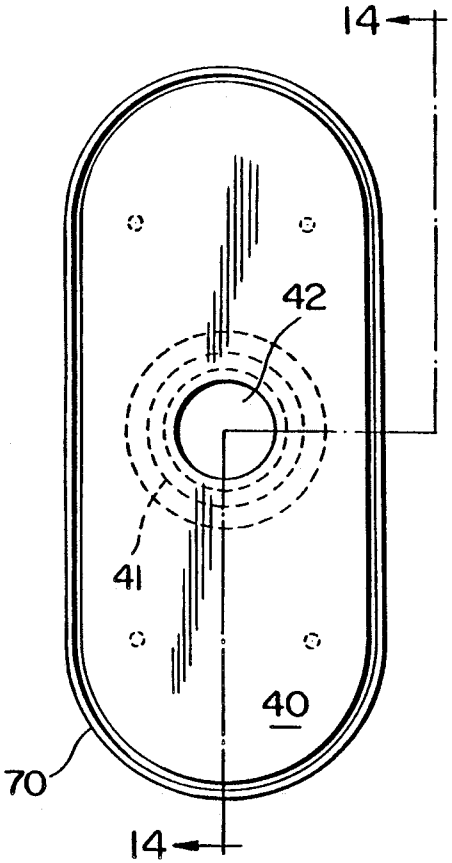
FIG. 13 is a view from above of the mobile refractory plate, inserted in its metal container.
Figure 14:
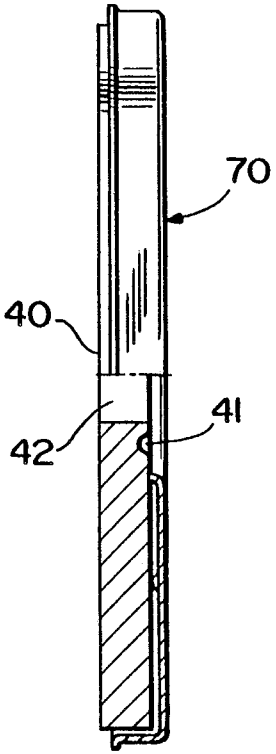
FIG. 14 is a side view of the same refractory plate, shown half as a cross-section.
Figure 15:
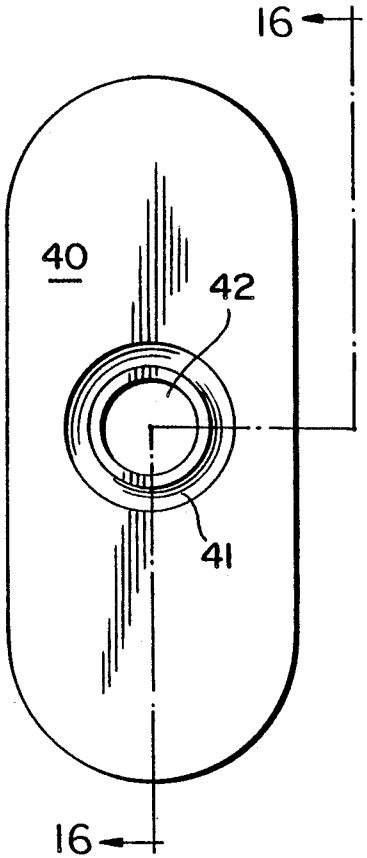
FIG. 15 is a view from above of the mobile refractory plate, without its metal casing.
Figure 16:
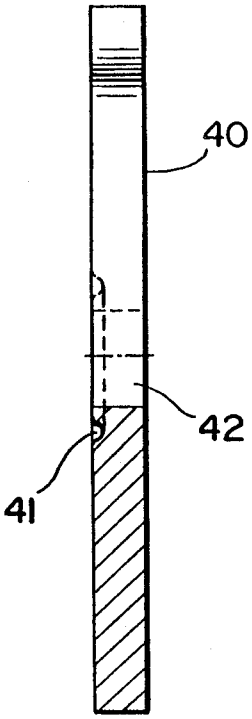
FIG. 16 s a side view of the mobile refractory plate, without its metal casing, shown half as a cross-section.
Figure 17:
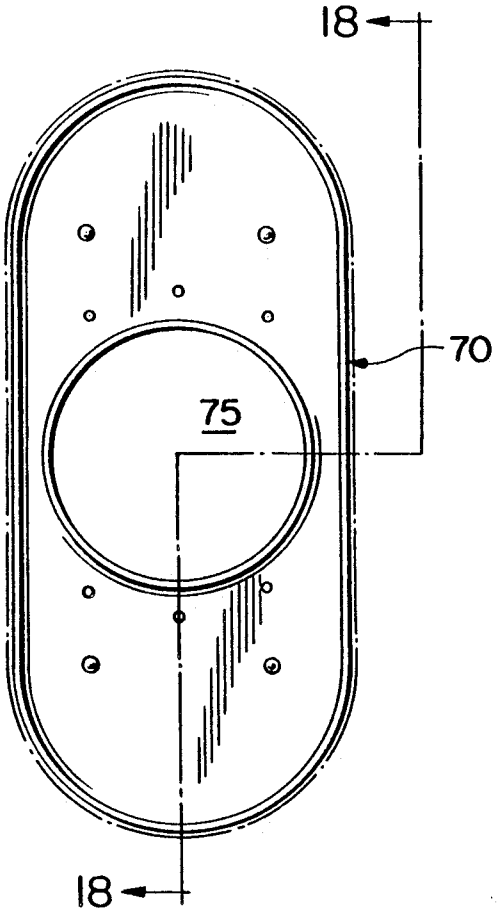
FIG. 17 is a view from above of the metal casing of the mobile refractory plate.
Figure 18:
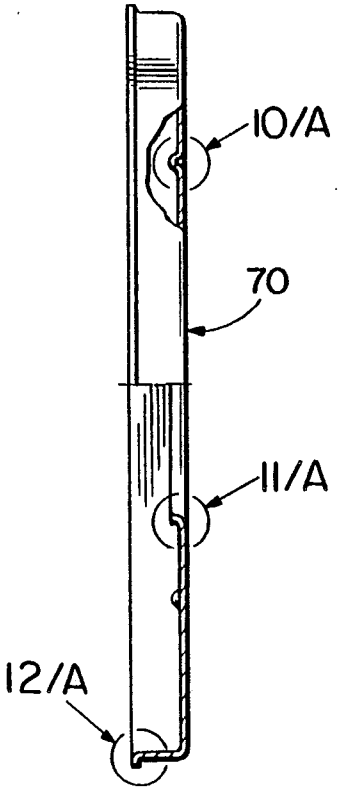
FIG. 18 is a side view of the same casing, shown half as a cross-section.
Figure 19:
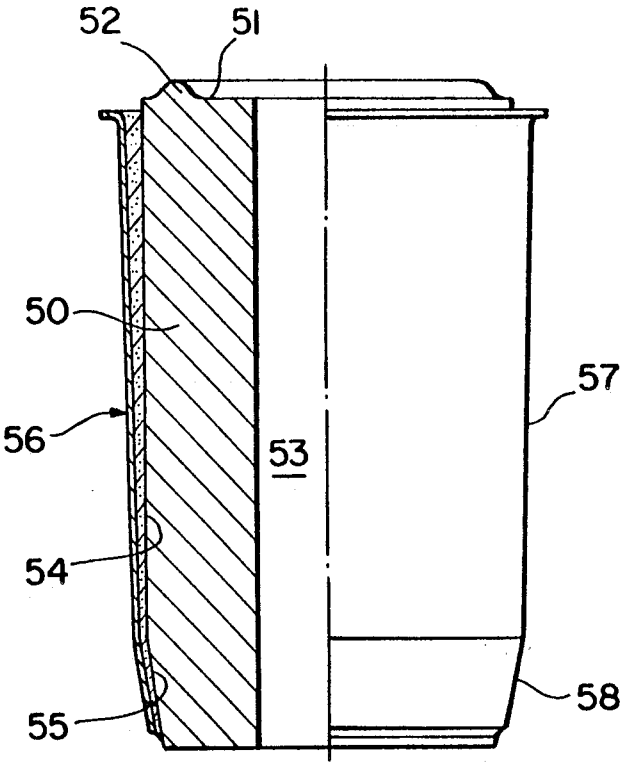
FIG. 19 is a side view, shown half as a radial cross-section, of the external pouring appliance, consisting of a sliding refractory sleeve fastened solidly to the lower plate and inserted inside its own metal casing.

The fixed upper plate 20 is illustrated in detail in FIGS. 3 and 12: it is symmetrical in respect of two orthogonal horizontal axes and its width is equal to approximately 5–7 times the radius R, while its length is approximately equal to 12–16 times the radius R.

The two ends 33 of the refractory plate 30 are shaped as semicircles with centres 34.

The distance between the centres 34 and 35 corresponds roughly to double the relative travel of the fixed and mobile plates.

In this way the distribution of the refractory material is optimized, as its free edges are always at the same distance from the area in contact with the molten steel, whatever the working position of the distribution device may be.

The fixed upper refractory plate 30 has a metal covering 60 consisting of a sheet of lamina 61 which covers the contour of the plate 30 and has an outer edge 62. The height of this edge 62 is approximately equal to the thickness of the plate 30 and its upper edge 63 is curved slightly outwards, as shown in the close-up of FIG. 12, so as to strengthen the covering itself and allow easy insertion of the plate 30 inside the covering 60 during assembly, without excessive clearances and consequent excessive thickness of the layer of refractory mortar 64 located between the plate 30 and the covering 60.

Furthermore, the covering 60 also has on the bottom 61 a circular opening 65, the rim 66 of which is folded inwards into an arch so as to create a supporting surface for the refractory plate which is supported at a pre-estabished height from the bottom 61 of the covering. The height of this rim 66 also defines the thickness of the layer of mortar.

The thickness of the layer of mortar 64 is also ensured by protrusions 67 made by presswork and arranged on the bottom 61.

It should be noted that the circular opening 65 in the bottom of the covering 60 is larger than the outside diameter of the internal pouring appliance 20, so that there is no interference, as shown in FIG. 1.

The sliding refractory plate 40 differs from the fixed refractory plate 30 in that the circular groove 41 has a smaller diameter in view of the lesser thickness of the lower refractory sleeve 50 as compared to the thickness of the internal pouring appliance 20.

This difference between the plates 30 and 40 on the one hand and the refractory sleeves 20 and 50 on the other, is very important for the purposes of the invention.

Indeed the internal pouring appliance 20 wears out more quickly than the sleeve 50 in the hole of which the flow of liquid steel is already perfectly directed along vertical flowlines.

By keeping to the dimensions indicated for the elements 11-12, 20, 30, 40 and 50, wear progresses at different rates but thanks to the different thicknesses involved, in such a way that the working life of these elements is approximately the same.

The maintenance activities for replacement of the worn parts of the shut-off device can therefore be scheduled rationally, with no losses due to replacement of only partly worn refractory elements.

As far as concerns the refractory sleeve 50, it should be noted that it too has a metal casing 56, with a double sloping truncated cone shape. The lower part 58 supports directly the weight of the sleeve 50, while the upper part 57 defines a meatus with a decreasing thickness inside which the connecting refractory mortar is placed.

What is claimed is:

1. A slide-gate shut-off device, comprising:

a fixed refractory plate and a sliding refractory plate beneath the fixed refractory plate, each of the plates having a pouring hole of constant radius R therein;

an external pouring appliance in the form of a refractory sleeve solidly connected to the sliding refractory plate, the sleeve having a radial thickness which is approximately constant throughout its length and approximately equal to the radius R of the pouring holes in the refractory plate;

an internal pouring appliance in the form of a fixed refractory sleeve above the fixed refractory plate, the sleeve becoming gradually thinner towards the top and having a radial thickness at its base adjacent the fixed refractory plate which is about the twice the radial thickness of the sleeve of the external pouring appliance at it base adjacent the sliding refractory plate; and a pouring appliance holder located around the internal pouring appliance.

2. The slide-gate shut-off device according to claim 1, wherein each plate is doubly symmetrical in plan view and the pouring hole of each plate is located at its center.

3. The shut-off device according to claim 1, characterized in that said refractory plates have semicircular shaped edges on the ends; the thickness of these plates is approximately equal to the radius R of the pouring hole passing through them.

4. The slide-gate shut-off device according to claim 1, characterized in that the outer surface of the internal pouring appliance is conical, narrowing towards the top, with an opening angle of about 2–6 degrees.

5. The shut-off device according to claim 1, characterized in that said internal pouring appliance has a height of about ten times R; in which the hole passing through the internal pouring appliance has two lengths, one on top of the other, the first or upper one of which is conical and opens upwards and the second or lower one of which is cylindrical with a radius equal to R; in which, furthermore, the height of the lower length is equal to about 3–5 times the total height of the internal pouring appliance, while the tangent of the opening angle of the upper conical length is equal to about 0.10–0.45.

6. The shut-off device according to claim 1 above, characterized by the fact that the radial thickness of the upper base of the internal pouring appliance is approximately equal to the radius R.

7. The slide-gate shut-off device according to claim 1, characterized by the fact that the height of the external pouring appliance is equal to about 6–12 times the radius R.

8. The slide-gate shut-off device according to claim 1, characterized by the fact that the pouring-appliance holder is equipped with an axial hole divided up into three superimposed lengths; the first of these lengths starting from the bottom has a conical surface suitable for accommodating the corresponding conical surface of the internal pouring appliance; the second of these lengths is cylindrical and has a height of about 0.2–2 times the radius R; the third of these lengths is again conical, and widens out upwards, with an opening angle of the tangent equal to about 0.2–0.4 and with a height of about 2–4 times the radius R.

9. The slide-gate shut-off device according to claim 8, characterized by the fact that the pouring-appliance holder consists of two superimposed elements, the mating surfaces of which are fitted with corresponding centering steps.

10. The slide-gate shut-off device according to claim 1, characterized in that each of the refractory plates has a width comprised between four and eight times the radius R and a length of about 12–16 times said radius R.

11. The slide-gate shut-off device according to claim 1, characterized by the fact that the internal pouring appliance has on the outer rim of its ring-shaped lower base a ring-shaped centering rib the corresponding seat of which is in a ring-shaped groove on the upper surface of the upper fixed plate.

12. The slide-gate shut-off device according to claim 1, characterized by the fact that the external pouring appliance has, in the vicinity of the outer rim of its ring-shaped upper base a ring-shaped centering rib the corresponding seat of which is in a ring-shaped groove on the upper surface of the lower sliding plate.

13. The slide-gate shut-off device according to claim 11, characterized by the fact that said ribs and grooves in the fixed plate and internal pouring appliance on the one hand, and in the sliding plate and external pouring appliance on the other hand, have different diameters.

14. The slide-gate shut-off device according to claim 1, characterized by the fact that both the fixed plate and the sliding plate are equipped with a metal covering made of sheeting covering the surface of the base opposite to the surface of reciprocal contact and the lateral surface around the edge.

15. The slide-gate shut-off device according to claim 14, characterized by the fact that the edges of said covering are folded outwards to make it easier to insert the refractory plate and to stiffen the covering.

16. The slide-gate shut-off device according to claims 14, characterized by the fact that the flat bottom of said metal covering has a circular opening with a diameter larger than that of the ring-shaped groove located on the associated refractory plate.

17. The slide-gate shut-off device according to claim 16, characterized by the fact that the edge of said opening is folded inwards, so as to stiffen the bottom of the covering and so as to keep the associated refractory plate away from said bottom of the casing by a certain pre-established distance, equal to the required thickness of refractory mortar.

18. The slide-gate shut-off device according to claim 17, characterized by the fact that protrusions are arranged on the bottom of the covering capable of defining, together with the folded edges of said opening, the resting surface of the refractory plate and thus the thickness of mortar required.

19. The slide-gate shut-off device according to claim 1, characterized by the fact that the external pouring appliance has a metal covering extending over its outer side surfaces.

20. The slide-gate shut-off device according to claim 11 characterized by the fact that the radial profile of said ring-shaped ribs and grooves has a substantially sinusoidal shape and preferably consists of three alternately concave and convex arches of a circle.

21. The slide-gate shut-off according to claim 1 wherein the sleeve connected to the sliding refractory plate has a substantially constant internal diameter and a substantially constant external diameter over at least a major part of its length.

* * * * *